US005508586A

United States Patent [19]

Martelli et al.

[11] Patent Number: 5,508,586

[45] Date of Patent: Apr. 16, 1996

[54] INTEGRATED GETTER DEVICE SUITABLE FOR FLAT DISPLAYS

[75] Inventors: Daniele Martelli; Raffaello Lattuada; Claudio Boffito; Mario Borghi; Giuseppe Urso, all of Milan, Italy

[73] Assignee: SAES Getters S.p.A., Italy

[21] Appl. No.: 257,059

[22] Filed: Jun. 8, 1994

[30] Foreign Application Priority Data

Jun. 17, 1993 [IT] Italy ..... MI93A1314
Nov. 12, 1993 [IT] Italy ..... MI93A2422

[51] Int. Cl.[6] ..... H01J 19/70
[52] U.S. Cl. ..... 313/560; 313/553
[58] Field of Search ..... 313/553, 554, 313/555, 556, 557, 560, 561

[56] References Cited

U.S. PATENT DOCUMENTS

| | | | |
|---|---|---|---|
| 2,183,841 | 12/1939 | King | 417/48 |
| 3,356,436 | 12/1967 | Porta | 445/3 |
| 3,719,433 | 3/1973 | Rabusin | 417/48 |
| 3,926,832 | 12/1984 | Barosi | 252/181.6 |
| 3,979,166 | 9/1976 | Zucchinelli | 417/48 |
| 3,996,488 | 12/1976 | Zucchinelli | 313/560 |
| 4,045,703 | 8/1977 | Mori et al. | 313/497 |
| 4,090,758 | 5/1978 | Wang et al. | 445/3 |
| 4,608,518 | 8/1986 | Fukuda et al. | 313/481 |
| 4,713,578 | 12/1987 | Josephs | 313/481 |
| 5,202,606 | 4/1993 | Vrijssen et al. | 313/450 |

FOREIGN PATENT DOCUMENTS

| | | | |
|---|---|---|---|
| 2118268 | 11/1971 | United Kingdom | H01J 29/94 |
| 2077487 | 12/1981 | United Kingdom | H01J 7/18 |
| 9305901 | 4/1993 | WIPO | B21D 13/10 |

*Primary Examiner*—Donald J. Yusko
*Assistant Examiner*—Lawrence Richardson
*Attorney, Agent, or Firm*—Hickman & Beyer

[57] ABSTRACT

The invention relates to an integrated getter device essentially consisting of at least one evaporable getter device and at least one non-evaporable getter device, wherein the different getter devices circumscribe areas at least partially superimposed or coincident, lying on essentially parallel or coincident planes and preferably arranged in a coaxial way.

14 Claims, 3 Drawing Sheets

INTEGRATED GETTER DEVICE SUITABLE FOR FLAT DISPLAYS

BACKGROUND OF THE INVENTION

The present invention related to an integrated getter device, suitable for flat displays.

As is known, the kinescopes, either of the conventional CRT type (Cathode Ray Tubes) or of the flat display type, contain getter materials having the task of fixing the traces of gas which may remain in the tube after its evacuation or come from the degassing of the materials constituting the same tube.

Particularly useful, as to this purpose, proved to be the combined use of evaporable getter and of non-evaporable getter (NEG) materials.

The evaporable getter materials are well known and are generally consisting of alloys which can release vapours of metal getter material, generally barium, at a temperature between 800° C. and 1200° C.; as to this subject, see the Italian Patent Application MI93-A-001314. The NEG materials are generally consisting of alloys based on titanium and/or zirconium.

At present, both these types of getter materials need, in order to be made operative, a thermal treatment at the beginning of the life-cycle of the kinescope, which may generally be carried out by means of radio frequencies (R.F.) emitted by an induction coil arranged outside the kinescope.

In the case of the evaporable getter material, the thermal treatment should allow the deposit of a metal film (hereinafter a barium film, namely the most commonly used material) in well defined and localized zones of the kinescope.

In the case of the NEG material, the task of the thermal treatment is to activate the material itself, that is initially present in a form which cannot react with the gases still lying in the kinescope.

THE PRIOR ART

The combined use of said getters in a kinescope, mentioned for instance in U.S. Pat. No. 3,356,436, is however showing, up to this time, a few drawbacks.

First of all, barium is a good electrical conductor and consequently its deposit on parts of a flat display, like electrodes, cathodes and connections with the outside, can engender a short-circuit or an electrical perforation of the insulating surfaces.

In order to overcome this problem, it was suggested to use a deflector, namely a baffle deflecting the Ba vapors and orienting said vapors towards a preferential direction; a solution of this type is illustrated for instance in the DE-A-2,118,268. By using the device illustrated in such German Patent Publication, it is however difficult to reach a perfect reproducible alignment of the deflector with respect to the barium housing, and that is why the drawback, represented by the barium deposition on undesired zones, is eliminated only in a partial way.

Other devices of the known technique, proposed for the same purposes, are described for instance in U.S. Pat. No. 2,822,080 and 3,816,788; such devices, however, can release only limited amounts of barium.

A further drawback, observed in the case of the flat displays, is residing in the fact that, because of their particular geometry, these displays show a lower mechanical strength than the conventional CRT tubes with respect to the pressure difference between outside and inside. This makes particularly critical the phase of thermal treatment for the activation of the getter device, because prolonged thermal treatments involve a localized thermal stress which an seriously compromise the mechanical strength of the flat display.

All this was discouraging the use of evaporable and non-evaporable getter devices in combination, such use being per se already know, for instance, from U.S. Pat. No. 3,356,436. This patent was concerning the use of two getter devices having annular shape, arranged normally to each other and activated by two different thermal treatments. Such a solution of the problem, however, although quite functional in the case of the conventional CRT tubes, is rather complicated because it requires a separate activation of the two different getter devices.

Other similar solutions, by which the evaporable getter and NEG devices, contemporaneously present in the display, are activated by different thermal treatments, would not solve the problem of minimizing the thermal stress of the screen.

Moreover, the activation of known non-evaporable getter and NEG devices,contemporaneously present in the display, are activated by different thermal treatments, would not solve the problem of minimizing the thermal stress of the screen.

Moreover, the activation of known non-evaporable getter devices requires a thermal treatment lasting at least 30 seconds, such that the activation step of the non-evaporable getter device, alone could be harmful to the mechanical strength of the flat display.

It is thus a first object of the present invention to provide an integrated getter device, comprising at least an evaporable getter device and a non-evaporable getter device, allowing to overcome at least one of the drawbacks of the known technique hereinabove.

A second object of the present invention is to provide an integrated getter device in which the non-evaporable getter device can be activated in shorter times with respect to prior art non-evaporable getter devices,and particularly in about 10 seconds or less.

Another object of the present invention is to provide an integrated getter device by which both the getter devices can be activated in a much simpler way with respect to prior art devices.

A further object of the present invention is to provide an integrated getter device depositing a reduced or null amount of barium onto undesired zones inside the display.

DISCLOSURE

The present invention achieves the objects hereinabove and still another objects, by means of an integrated getter device comprising at least one evaporable getter device and at least one non-evaporable getter device, wherein said at least two different getter devices circumscribes areas at least partially superimposed or coincident, lying on essentially parallel or coincident planes and preferably arranged in a coaxial way, and wherein said at least two different getter devices are in thermal contact with each other. The thermal contact between the at least two different getter devices can be obtained by realizing the housing of the two getter materials in a single piece of a heat conducting material, generally a metal; in alternative, the thermal contact can be obtained by joining at least two such heat conducting housings in such a ay as to establish a good thermal bridge between them, for instance by welding them on a large area.

The present invention will be now described in detail with reference to the following description and drawings wherein.

Figure 2A:
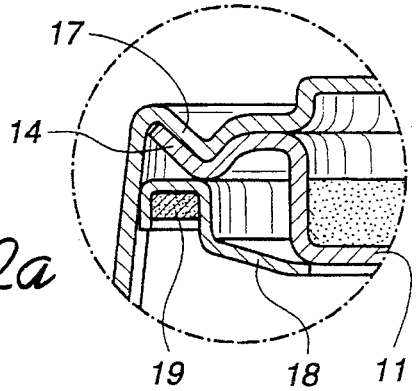
FIG. 2 is a sectional view of a getter device of the present invention taken along line 2—2 of FIG. 1.
Figure 2:
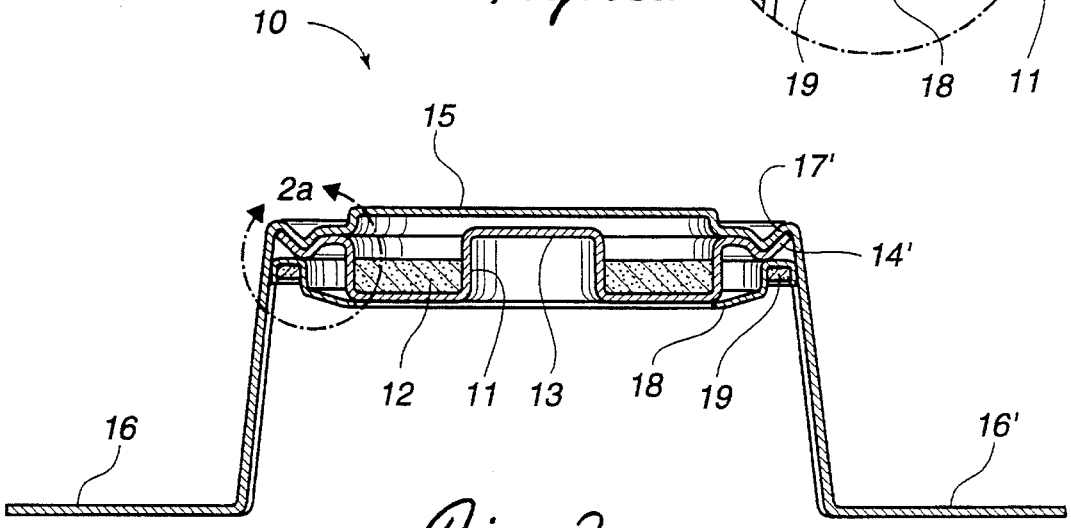
Figure 3:
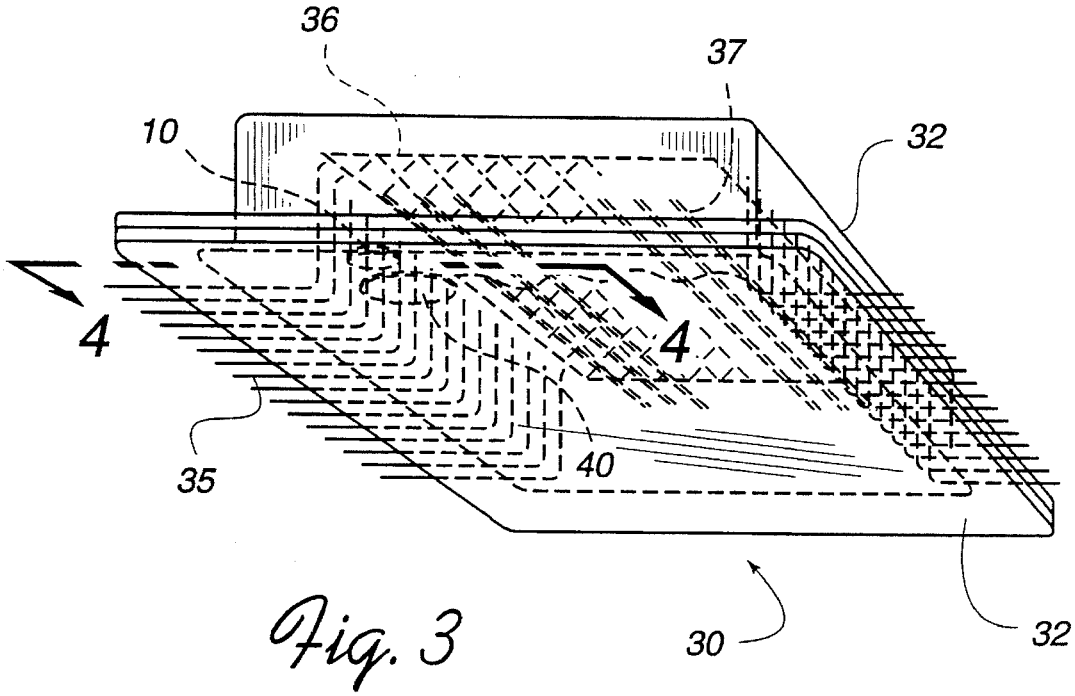
Figure 4:
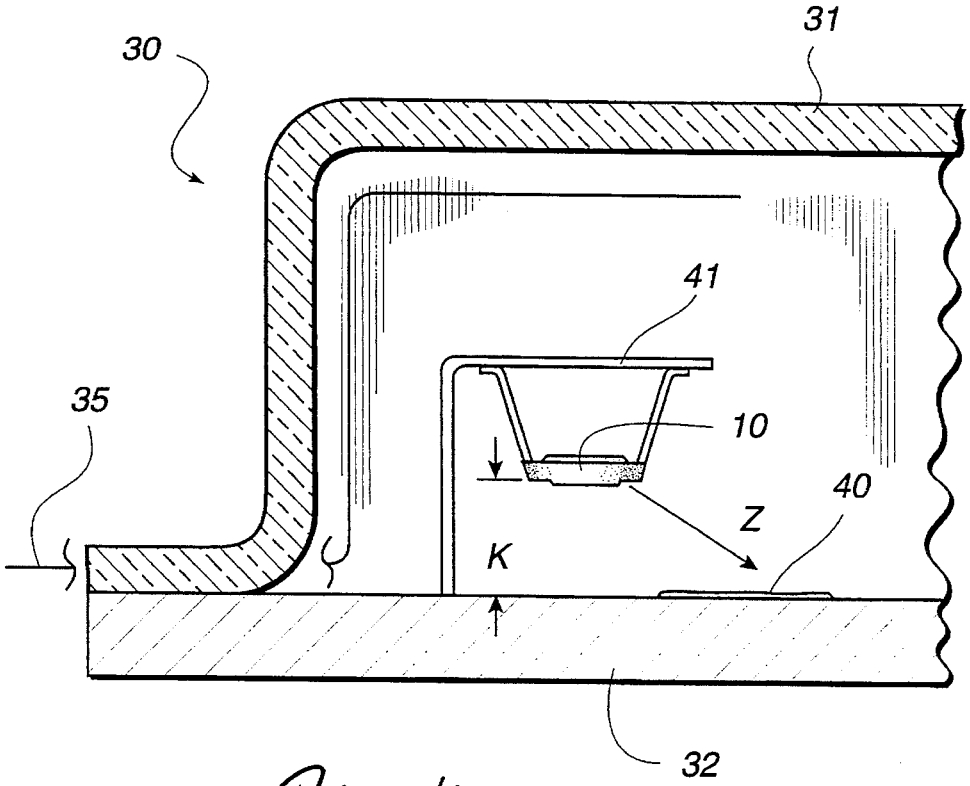
Figure 5:
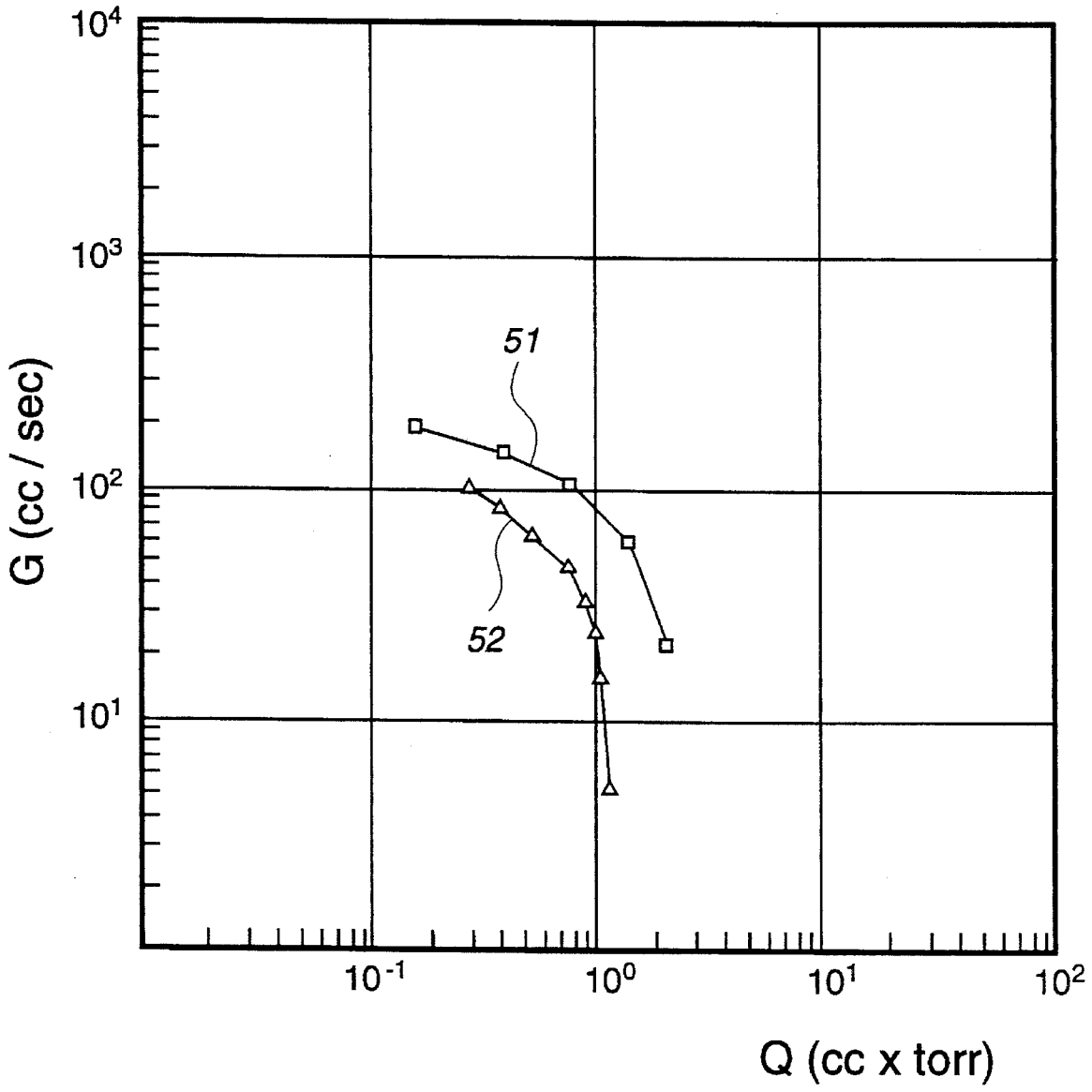

FIG. 2*a* is an enlarged view of the indicated portion of FIG. 2;

FIG. 3 is an assonometric layout of a flat display under vacuum, containing also an integrated getter device according to the invention;

FIG. 4 is an inverted partial sectional view of the flat display of FIG. 3 taken along line 4—4 of FIG. 3; and FIG. 5 shows the results of hydrogen absorption tests: in the graph, on the "y" axis is reported the speed of absorption G, measured in cc/s, and on the "x" axis is reported the quantity of absorbed hydrogen Q, measured in (cc×torr).

Coming into the details, the evaporable getter device and the non-evaporable getter device comprise two toroidal rings having two circular axes lying in parallel, more or less coincident planes, each circular axis being normal, in each of its points, to the corresponding cross-section of its town terms: moreover, said evaporable getter and NEG device have a common central straight axis, normal to said parallel or coincident planes.

According to a particularly advantageous embodiment, the different getter devices show an annular shape and the evaporable getter device is surmounted by a deflector orienting the vapors of evaporable getter material along a unique preferential direction.

Figure 1:
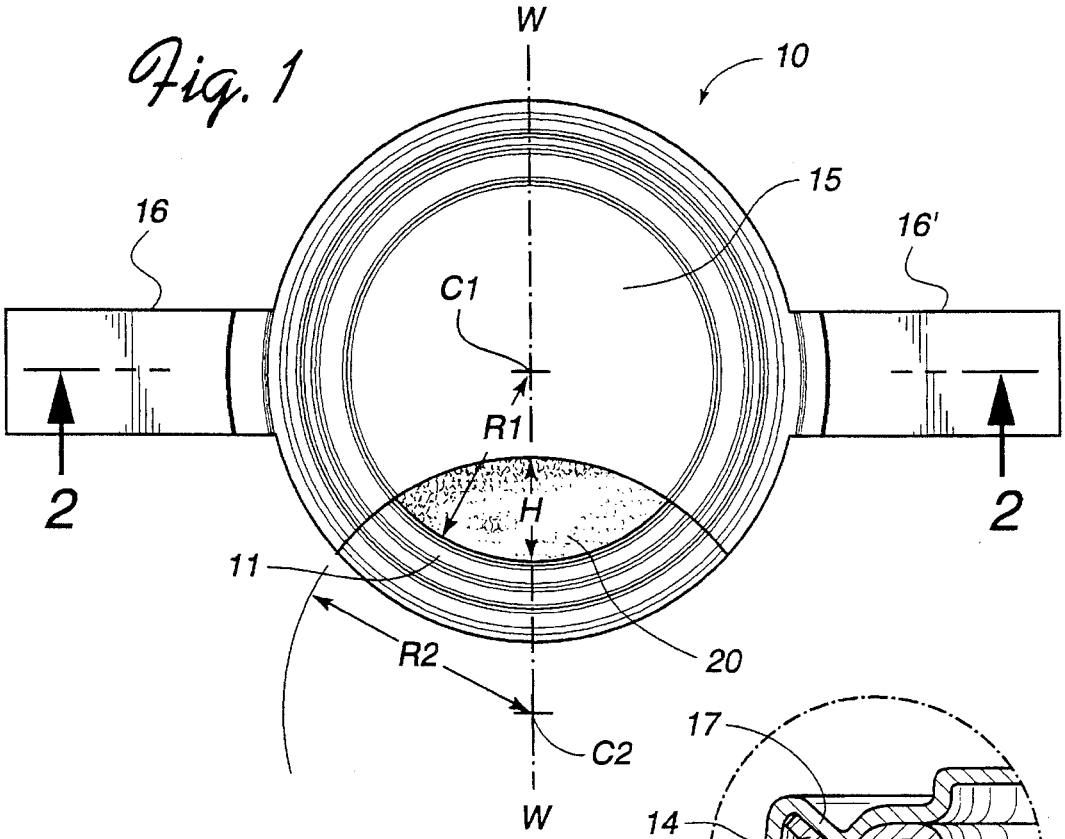
FIG. 1 is a plan view of a getter device of the present invention.

In FIG. 1 and FIG. 2 are shown, respectively, a view from above and a sectional side view of an integrated getter device 10 of the invention.

Said device comprises at least one evaporable getter device, defined by a housing 11, having at its external part a labyrinth ramification 14, 14', and a central elevation 13; the housing 11, is surmounted by a deflector 15, and is filled with the evaporable getter material 12.

The border of deflector 15 is shaped as to match the labyrinth ramification 14, 14' of housing 11, having a corresponding labyrinth ramification 17, 17'. At two diametrally opposed points, the deflector 15 has fixed the supports 16 and 16', that carry the whole structure.

On the rear side of the housing 11 there is fixed, for example by spot welding, a second housing 18 containing a NEG material 19, thus defining a NEG device.

As it can be observed, the areas circumscribed by the two rings are lying on practically coincident planes, wherein the area included in the ring of NEG material 19 is broader than the circular area surrounded by the ring of evaporable getter material 12.

The evaporable getter material 12 is a composition of matter that gives rise to an exothermic reaction.

Such compositions are well known in the field, and generally comprise an admixture of powders of nickel with powders of a barium alloy of raw formula $BaAl_4$.

When, upon external heating, the mixture reaches a temperature of about 800° C., the following reaction takes place;

$$BaAl_4+4\ Ni \rightarrow Ba+4\ NiAl$$

The heat generated by the reaction causes the barium to evaporate, and, in the particular arrangement of getter devices of the present invention, part of this heat is also transferred to the non-evaporable getter device, thus contributing to its activation in a very short time.

The above described external heating can be performed using radio frequency energy supplied from an external radio frequency source as will be well known to those of skill in the arts of solid state devices and gettering. One example of such external heating using a radio frequency source can be found in U.S. Pat. No. 3,356,436 to della Porta.

The non-evaporable getter material 19 may be consisting of particular alloys based on zirconium and/or titanium; we may cite, for merely indicative purposes:

a) the zirconium-aluminium alloys (known also as St 101 alloys), described by U.S. Pat. No. 3,203,901, and the zirconium-nickel and zirconium-iron alloys described by U.S. Pat. No. 4,071,335 and 4,306,887;

b) the Zr-M1-M2 alloys, described by U.S. Pat. No. 4,269,624 (wherein M1 is selected from V and Nb and M2 is selected from Fe and Ni) and the Zr-Ti-Fe alloys, described by U.S. Pat. No. 4,907,948;

c) the alloys containing zirconium and vanadium and in particular the Zr-V-Fe alloys (especially the ones known as St 707 alloys), as per U.S. Pat. No. 4,312,669; these alloys, as is known from GB 2,077,487 may be endowed with a higher porosity by a suitable combination with zirconium and/or titanium powders or hydrides thereof;

d) the combination described in U.S. Pat. No. 3,926,832, comprising:

i) a getter metal selected from Zr, Ta, Hf, Nb, Ti, Tb, U and mixtures thereof;

ii) the already quoted zirconium-aluminium alloys, as per item a) hereinabove.

This last peculiar combination of item d) provide extremely advantageous results, especially when said getter metal is titanium.

Coming now to the geometric details of the integrated getter device of the invention, the evaporable getter device may be essentially consisting of:

i) a housing 11 in the form of a hollow disk, having a toroidal groove, limited by an essentially cylindrical outer wall, provided with an inner circular border having centre C1 and radius R1;

ii) an evaporable getter material 12 inserted into said groove;

iii) a deflector 15 allowing a sole preferential escaping direction of barium vapors, essentially concentric with said housing 11, wherein said deflector has a notch essentially consisting of an arc of circle, having centre C2, different from C1, and radius R2 such that the ratio R2:R1 ranges from about 3 to about 1, which forms, with said inner circular border of said groove, a slit having the shape of an almond or of a crescent. The slit is defined by the intersection of the edge of said notch with said circular border.

The maximum transversal width H of the slit, along its W—W axis containing both the centres C1 and C2, is from 0.5 mm to R1. In the case, for instance, of a 14" kinescope it may occur to have advantageously: R1=6.5 mm; H=4 mm; R2=1.1×R1.

The shape of the cross-section of the toroidal ring may be selected from the circular, elliptical, oval, polygonal shapes and from the U shape.

The deflector 15, preferably obtained by a cold bending of a sole sheared plate, has a notch shaped as an arc of a circle forming, with the border of the housing 11 a slit 20 consisting of a circular intersection, hereinafter also "almond slit" or "buttonhole", namely an essentially plane opening having a perimeter defined by the intersection of two circumferences having radius R1 and R2 and having centres C1 and C2, lying on the centre line W—W normal to the main axis Y—Y of the supports 15, 16'. Deflector 15 and housing 11 may be assembled by spot projection welding. Diameter D1 (=2R1) is the inner diameter of the outer cylindrical wall of said toroidal groove of housing 11; radius R2 is chosen such that the ratio R2:R1 may vary between about 3 and about 1.

The maximum width H of the slit is generally comprised between 0.5 mm and R1 and the distance (L) between centres C1 and C2 is supplied by equation (I):

$$L=R1+(R2-H) \quad (I)$$

The outer wall of the deflector is spaced from the inner wall of the flat display, whereonto the evaporable getter is deposited, by a distance K equal to a few millimetres, for instance 10 mm in the case of a 14" flat display (see FIG. 4).

An alternative kind of deflector (showing a slit having the shape of a crescent) is described in U.S. Pat. No. 3,996,488.

Two labyrinth shaped ramifications 14 and 14' allow the integration of the housing 11 with the concentric deflector 15, provided with supports 16 and 16', respectively matching, at their proximal ends 17 and 17', said ramification 14 and 14'. Said supports 16 and 16' constantly keep the getter device at the proper an desired distance from the inner wall of the flat display, made from glass, thus avoiding the contact with the glass during the evaporation phase, when the temperatures at stake (sometimes 1200°–1300° C.) are so high as to be dangerous to flat display itself.

The supports 16 and 16' may be made of simple metallic tape of plan section; however, other profiles, like for example an arched profile, or a C profile, provide stiffening, a higher mechanical strength, and higher dimensional stability, as well as a minimization of the contact temperature at the critical point, namely the point where the getter device is clasped to the inner structure of the flat display. As an alternative, the stiffening can be advantageously obtained by a corrugation pattern on the metal band-support.

The profile of the cross-section of said supports may be a simple thin rectangle, but if it is desirable to reach a higher stiffening degree, it is used an arched cross-section or a C cross-section; as an alternative said supports may be reinforced by a corrugation pattern.

As an alternative, other kinds of supports may be used, like the ones, for instance, mentioned in the U.S. Pat. No. 3,558,962, 3,996,488 and 4,323,818.

The housings 11 and 18 can be made, for instance, of stainless steel, and their walls have normally a thickness of a few tenths of millimetre. (for instance 0.5 mm).

The shape of the slit of device 10 gives rise to a slow controlled emission of the vapors of barium the sole preferential direction Z of FIG. 4, thus promoting the creation of the deposit 40 of barium in the preselected position of the inner wall 32 of the flat display 30 and only in such a position.

In more precise terms, the along shape of said silt succeeds in focusing the vapor flow, thus minimizing the lateral dispersion of the vapor and restricting the angle of the expansion cone of the vapor in an extremely effective way.

Also the labyrinth ramifications 14 and 14' considerably help in restraining the lateral fan-shaped dispersion of the getter vapors.

Following now FIG. 3 and FIG. 4, we can observe:

—the whole flat display 30 comprising the screen 31 (on the inner wall of said screen there are the phosphors);

—th bottom of the flat display 30 on this bottom is formed a deposit 40 of evaporable getter material, coming from the getter device 10, having a slit, not indicated in FIG. 3, which unidirectional orientates the vapors of barium just towards said bottom according to the preferential direction Z, wherein said device is welded to the plate 41;

the feedthrough 35 for feeding gate 36, said gate having the function of focusing the electronic cloud engendered by the wire cathodes 37.

The details of FIG. 5 are retrievable in the examples.

The following examples are supplied for merely illustrative purposes and do not limit in any way the spirit and the scope of the invention.

EXAMPLE 1

An integrated getter device (of the type illustrated in FIG. 1) having a diameter D1 approximately equal to 13 mm (R1=D1:2=6.5 mm was prepared by using:

—as the evaporable getter material a compressed mixture obtained from a $BaAl_4$ alloy, a Ni powder and a $Fe_4N$ powder;

—as the NEG getter material (NEG), a mixture of titanium powder (40% b.w.) with a zirconium-aluminium alloy, (60% b.w.); said Zr-Al alloy, known as St 101, in its turn was essentially containing 16% b.w. of aluminium and 84% b.w. of zirconium.

The integrated getter device was then activated for 10 seconds at about 950° C. and subsequently submitted to a hydrogen sorption test.

The results were recorded on FIG. 5 as line 51, wherein the pumping rate G and the amount of adsorbed hydrogen Q were calculated as indicated in the international patent application PCT/IT/93/00040, in the name of the applicant.

EXAMPLE 2

This example is comparative only in the sense that it compares a getter device of the present invention to that of Example 1 but having a different non-evaporable getter material. The devices of both Examples 1 and 2 are representative of the present invention.

Example 1 was repeated replacing the NEG mixture by an alloy containing manganese, namely the alloy $Zr(fe_{0.5}Mn_{0.5})_2$ commercially known as St 909 and described in U.S. Pat. No. 5,180,568.

The results of this test were recorded on FIG. 5 as line 52.

The sorption rates (G), in correspondence of equal amounts of adsorbed hydrogen (Q) were lower, which clearly shows the superiority of the integrated getter device of Example 1.

Nobody did succeed till now to single out a combination of evaporable getters and ENG devices which could, in the order:

—withstand the fritting temperature;

—tolerate all the stresses coming from the assembling of the kinescopes;

—withstand a high activation temperature (unique for both the different getter materials); and, nevertheless:

—create and maintain an excellent vacuum degree.

The present invention, in particular, permits contemporaneous activation of the combination of two different getter devices (evaporable and NEG) and moreover in an extremely short time, namely a time equal to or lower than 10 or even 7 seconds (while the double activation till now performed was requiring a time not less than 30 seconds, and up to several minutes), and to nevertheless obtain essentially equal results in terms of hydrogen pumping.

Such an advantage can be even more appreciated if it is considered the complicated method hitherto exploited for the manufacture of flat displays. According to this process, in fact, there were prepared two separate parts of the kinescope (made from glass), then one or more getter devices were fastened to at least one of said parts, the two parts were assembled by fritting, and finally a proper degree of vacuum was created by means of pumping. By the term "fritting" is meant a process in which two glass parts are sealingly joined by applying at the contact surfaces a glass paste of a lower melting temperature than the glass of the parts to be joined, and then heating the assembly up to the melting temperature of the paste, generally at between 350°–500° C.

What is claimed is:

1. An integrated getter device comprising at least one evaporable getter device and at least one non-evaporable getter device, wherein said at least two different getter devices circumscribe areas at least partially superimposed or coincident, lying on essentially parallel or coincident planes and arranged in a coaxial way, and wherein said at least two different getter devices are in thermal contact, said evaporable getter device consisting essentially of:

i) a housing in the form of a hollow disk, having a toroidal groove, limited by an essentially cylindrical outer wall, provided with an inner circular border having centre C1 and radius R1;

ii) an evaporable getter material inserted into said groove;

iii) a deflector having a sole preferential direction, essentially concentric with said housing, wherein said deflector shows a notch essentially consisting of an arc of circle, having centre C2, different from C1, and radius R2 such that the ratio R2:R1, ranges from about 1 to about 3 which forms, with said inner circular border of said groove, a crescent-shaped slit.

2. The integrated device of claim 1, wherein the maximum transversal width (H) of the slit, along its W—W axis, containing both the centres C1 and C2, is from 0.5 mm to R1.

3. The integrated device of claim 1, wherein the deflector is supplied with metal band-supports having a common axis Y—Y, normal to the transverse axis W—W of the slit and passing through centre C1 of the housing, wherein the proximal ends of said supports are shaped in the form of a labyrinth, matching two ramifications of said housing, having too the shape of a labyrinth, and wherein said supports are selected from:

the supports showing a rectangular cross-section;

b) the supports showing an arched cross-section;

c) the supports showing a C cross-section;

d) the supports showing a corrugation pattern;

e) combination thereof.

4. The integrated getter of claim 1, wherein said evaporable getter device and said non-evaporable getter device are essentially consisting of two toroidal rings having two circular axes lying on parallel or coincident planes, each circular axis being normal, in each of its points to the corresponding cross-section of its own torus, and wherein said devices having a common control straight axis, normal to said parallel or coincident planes.

5. The integrated device of claim 4, wherein the diameter of the circular axis of said evaporable getter device is lower than the diameter of the circular axis of said non-evaporable getter device.

6. The integrated device of claim 4, wherein the shape of the cross-section of the toroidal rings is selected from the circular, elliptical, oval, polygonal shapes and from the U shape.

7. The integrated device of claim 1, wherein the evaporable getter material comprises a mixture of $BaAl_4$ powder and Ni powder.

8. The integrated device of claim 1, wherein the non-evaporable getter material is a getter composition based on zirconium and/or titanium.

9. The integrated device of claim 8, wherein said composition is selected from:

a) the Zr-Al alloys, the Zr-Ni alloys and the Zr-Fe alloys;

b) the Zr-Ti-Fe alloys and the Zr-M1-M2 alloys, wherein M1 is selected from V and Nb and wherein M2 is selected from V and Mb and wherein M2 is selected from Fe and Ni;

c) the alloys containing zirconium and vanadium and in particular the Zr-V-Fe alloys, optionally endowed with a higher porosity by combination with powders of Zr and/or Ti and/or hydrides thereof.

10. The integrated device of claim 8, wherein said composition is selected from the mixtures of a Zr-Al alloy with a getter metal selected from Zr, Ta, Hf, Nb, Ti, Th, U and combinations thereof.

11. The integrated device of claim 10, wherein said getter metal is titanium.

12. A flat display under vacuum, containing at least one integrated getter device according to claim 6.

13. The integrated getter device comprising:

A. an annular evaporable getter device portion;

B. an annular non-evaporable getter device portion coaxial with the annular evaporable device portion;

C. a deflector carried by the annular evaporable getter device portion; wherein the deflector provides means for directing vapors of evaporable getter material in a unique preferential direction;

wherein the two portions circumscribe superimposed areas in essentially coincident planes;

wherein the evaporable better device portion comprises:

i. a housing in the form of a hollow disk having a toroidal groove limited by an essentially cylindrical outer wall, provided with an inner cylindrical border having centre C1 and radius R1;

ii. an evaporable getter material containing barium carried by the groove;

iii. the deflector has a sole preferential direction, essentially concentric with the housing, wherein said deflector carries a notch of an arc of a circle having centre C2, different from C1, and a radius R2 such that the ratio R2:R1 is from about 1:1 to about 3:1 and which forms with said inner circular border of said groove, a crescent shaped slit.

14. An integrated getter device comprising:

A. an annular evaporable getter device portion, including a barium releasing material of $BaAl_4$ and Ni, capable of giving rise to an exothermic reaction whereby barium is evaporated;

B. an annular non-evaporable getter device portion, and in thermal contact with said evaporable device portion, whereby heat generated by the exothermic reaction of $BaAl_4$ plus Ni is transmitted to the non-evaporable getter material thereby activating it;

C. a deflector carried by the annular evaporable getter device portion; wherein the deflector provides means for directing vapors of evaporable getter material in a unique preferential direction;

wherein the two portions circumscribe superimposed areas in essentially coincident planes;

wherein the evaporable getter device portion comprises:

i. a housing in the form of a hollow disk having a toroidal groove limited by an essentially cylindrical outer wall, provided with an inner cylindrical border having centre C1 and radius R1;

ii. an evaporable getter material containing barium carried by the groove;

iii. the deflector has a sole preferential direction, essentially concentric with the housing, wherein said deflector carries a notch of an arc of a circle having centre C2, different from C1, an a radius R2 such that the ratio R2:R1 is from about 1:1 to about 3:1 and which forms with said inner circular border of said groove, a crescent shaped slit.

* * * * *

UNITED STATES PATENT AND TRADEMARK OFFICE

CERTIFICATE OF CORRECTION

PATENT NO. : 5,508,586

DATED : April 16, 1996

INVENTOR(S) : Martelli et al.

It is certified that error appears in the above-indentified patent and that said Letters Patent is hereby corrected as shown below:

Column 2, line 4, change "an" to --can--
Column 2, line 9, change "know" to --known--
Column 2, line 31, after "device" delete ","
Column 2, line 55, change "another" to --other--
Column 3, line 1, change "ay" to --way--
Column 3, line 27, change "town" to --own--
Column 3, line 28, after "terms", change ":" to --;--
Column 3, line 65, after "place", change ";" to --:--
Column 5, line 27, change "an" to --and--
Column 5, line 55, change "of" to --on--
Column 5, line 58, change "along" to --almond--
Column 5, line 66, insert --,-- after "30"
Column 6, line 1, change "th" to --the--
Column 6, line 54, change "ENG" to --NEG--
Column 7, line 62, change "having" to --have--
Column 8, line 43, change "better" to --getter--
Column 5, line 3, change "15" to --16--
Column 8, line 17, change "Mb" to --Nb--
Column 8, line 31, change "The" to --An--

Signed and Sealed this

Twenty-seventh Day of August, 1996

*Attest:*

Bruce Lehman

BRUCE LEHMAN

*Attesting Officer*

*Commissioner of Patents and Trademarks*